United States Patent [19]

Nedoluha

[11] Patent Number: 4,681,052

[45] Date of Patent: Jul. 21, 1987

[54] INHAUL BOOM END FOR SAILBOARD BOOM ASSEMBLY

[75] Inventor: Heinz F. Nedoluha, Salzburg, Austria

[73] Assignee: The Coleman Company, Inc., Wichita, Kans.

[21] Appl. No.: 811,023

[22] Filed: Dec. 19, 1985

[51] Int. Cl.[4] ..... B63B 15/00

[52] U.S. Cl. ..... 114/98; 114/39

[58] Field of Search ..... 114/97–99, 114/102–103, 39, 39.2

[56] References Cited

U.S. PATENT DOCUMENTS 4,319,536 3/1982 Schweitzer et al. ..... 114/99

FOREIGN PATENT DOCUMENTS 3326775 2/1985 Fed. Rep. of Germany ..... 114/97

*Primary Examiner*—Joseph F. Peters, Jr.
*Assistant Examiner*—Jesûs D. Sotelo

[57] ABSTRACT

An inhaul boom end part for a sailboard boom assembly is molded integrally from plastic. The inhaul boom end part is generally V-shaped and includes a pair of tubular portions for attachment to the booms and a central portion. The central portion includes top and bottom surfaces and a generally semi-cylindrical arcuate surface for engaging a mast of a sailboard. A central bore extends perpendicularly through the boom end part adjacent the semi-cylindrical surface, and second and third bores extend perpendicularly through the boom end part. A jam cleat slot in the top surface extends between the central bore and the second bore, and a jam cleat slot in the bottom surface extends between the central bore and third bore.

13 Claims, 7 Drawing Figures

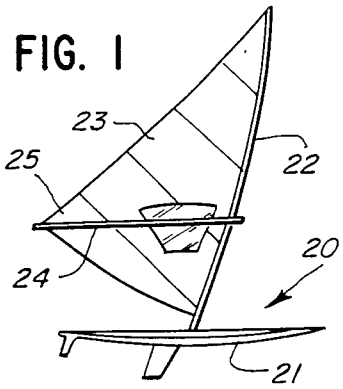
FIG. 1
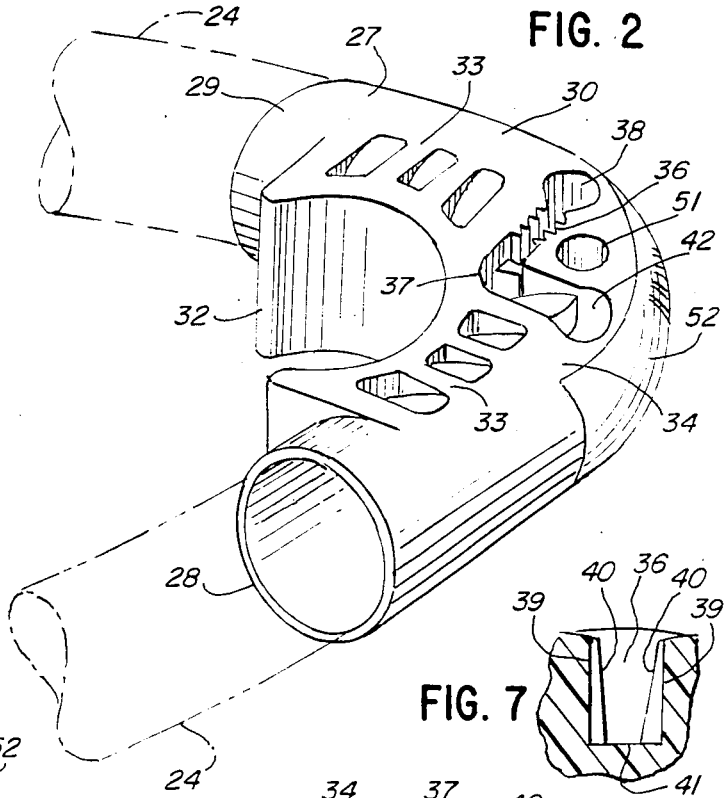
FIG. 2
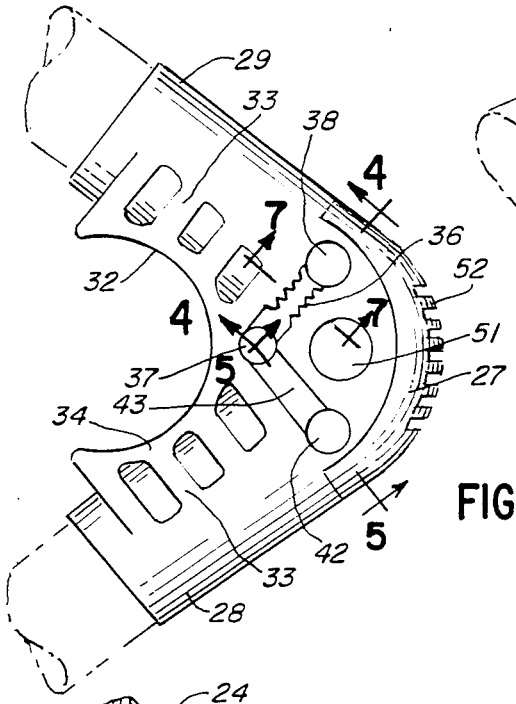
FIG. 3
FIG. 7
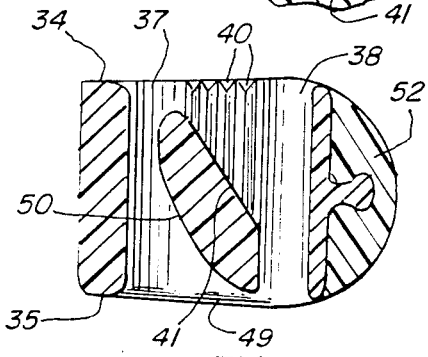
FIG. 4
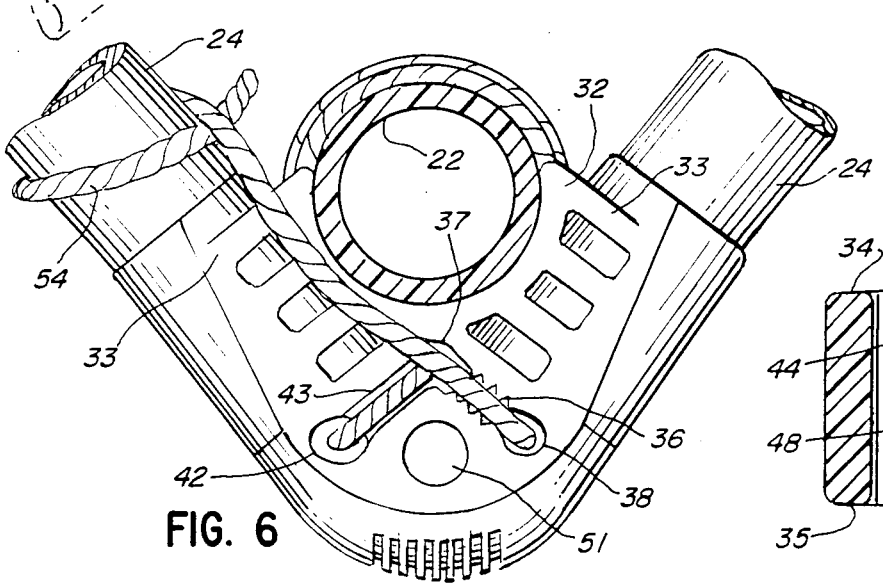
FIG. 6
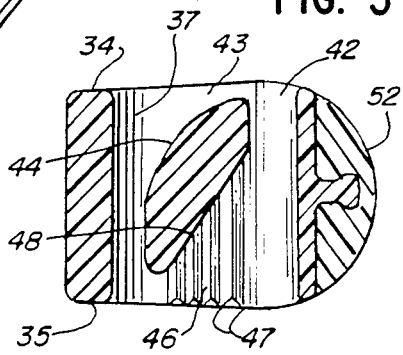
FIG. 5

INHAUL BOOM END FOR SAILBOARD BOOM ASSEMBLY

BACKGROUND

This invention relates to sailboards, and, more particularly to an inhaul boom end part for a sailboard boom assembly.

The boom assembly of a sailboard typically includes a pair of elongated tubular booms which extend along opposite sides of the sail, an inhaul boom end part which is attached to the mast, and an outhaul boom end part which cooperates with an outhaul line for tensioning the sail.

The boom assembly is mounted on the mast by lashing the inhaul boom end to the mast. However, the lashing operation is frequently difficult and time-consuming, and it is often difficult to maintain sufficient tension on the lash line to provide a secure connection between the mast and the boom end part.

The boom assembly is attached to the mast before the mast is mounted on the sailboard. In the usual method of attaching the boom assembly, the mast and boom assembly lie on the ground with the mast extending between the booms and the outhaul ends of the booms extending almost parallel with the upper end of the mast. A line is wrapped around the mast and attached to the inhaul end of the boom assembly, and the booms are then moved to an operating position in which they extend generally perpendicularly to the mast to tighten the line.

However, the foregoing procedure is not possible for all types of sails, particularly those with long battens. In some cases the boom assembly is positioned so that the outhaul ends of the booms extend along the lower end of the mast while the line is wrapped around the mast and attached to the inhaul end. It is desirable that the boom inhaul end can be attached to the mast in either position so that the booms and the outhaul end of the boom assembly do not have to be turned.

U.S. Pat. No. 3,574,900 describes cleats which are commonly used to secure lines on sailboard boom assemblies. However, these cleats are expensive, are subject to breaking, and protrude from the boom assemblies.

SUMMARY OF THE INVENTION

The invention provides an inhaul boom end part with recessed cleat slots on both the top and bottom surfaces of the boom end part. Each cleat slot communicates with the opposite surface through a perpendicular bore in the inhaul part, and the cleat slots angle toward each other and terminate in a central bore through the inhaul part. The two cleat slots and the perpendicular bores permit the inhaul part to the lashed mast with either the top or bottom surface of the inhaul part facing the mast. When the booms are rotated into the operating position which is generally perpendicular to the mast, the cleat slots move away from the mast and tension the lash line.

DESCRIPTION OF THE DRAWING

The invention will be explained in conjunction with an illustrative embodiment shown in the accompanying drawing, in which FIG. 1 is a side elevational view of a sailboard which is equipped with an inhaul boom end part in accordance with the invention;

FIG. 2 is an enlarged perspective view of the inhaul boom end part;

FIG. 3 is a top plan view of the inhaul boom end part;

FIG. 4 is a fragmentary sectional view taken along the line 4—4 of FIG. 3;

FIG. 5 is a fragmentary sectional view taken along the line 5—5 of FIG. 3;

FIG. 6 is a fragmentary top plan view showing the inhaul boom end part lashed to the mast; and FIG. 7 is an enlarged fragmenary sectional view taken along the line 7—7 of FIG. 3.

DESCRIPTION OF SPECIFIC EMBODIMENT

Referring first to FIG. 1, a conventional sailboard 20 includes a board 21, a mast 22 which is mounted on the board, and a sail 23 which is supported by the mast. A pair of booms 24 are attached to the mast and extend along opposite sides of the sail for tensioning the tack 25 of the sail and for providing a handhold for the sailor. With the exception of the boom assembly which will be described in part hereinafter, the sailboard 20 is conventional and well known in the art.

Referring now to FIGS. 2–7, an inhaul boom end part 27 is attached to the forward ends of the booms 24 and the mast 22. The inhaul boom end part is generally V-shaped and includes a pair of diverging tubular portions 28 and 29 and a central portion 30 which connects the tubular portions. Each of the booms 24 is inserted into one of the tubular portions 28 and 29 and secured therein by screws or rivets.

An arcuate wall 32 which is generally in the form of a half cylinder is formed integrally with the tubular portions 28 and 29 and the central portion 30 and bears against the mast 22 when the boom end part is lashed to the mast as shown in FIG. 6. Ribs 33 extend between the cylindrical wall 32 and the tubular portions.

The boom end part 27 includes top and bottom surfaces 34 and 35 (FIGS. 4 and 5) which are mirror images of each other. In other words, if the boom end part illustrated in FIG. 3 were inverted, the bottom surface 35 would look the same as the top surface 34.

A jam cleat slot 36 is formed in the top surface 34 and extends between bores 37 and 38 which extend perpendicularly through the part between the top and bottom surfaces. The cleat slot 36 is defined by a pair of substantially parallel side surfaces 39 (FIG. 7), and a plurality of cleat ridges 40 extend along each of the surfaces 39 in a direction which is parallel to the axes of the perpendicular bores 37 and 28 (see FIG. 4). The bottom of the cleat slot 36 is formed by a bottom surface 41 (FIG. 4) which slants upwardly from the bore 38 to the bore 37. As can be seen in FIG. 7, the peaks of opposing cleat ridges 40 diverge upwardly from the bottom surface 41 so that the distance between the peaks of opposing ridges is less at the base of the ridges than at the top.

A third perpendicular bore 42 (FIG. 3) extends through the boom end part 27, and a slot 43 extends between the bore 42 and the central bore 37. Referring to FIG. 4, the bottom of the slot 43 is formed by a bottom surface 44 which curves upwardly from the central bore 37 to the bore 42.

The bottom surface 35 of the inhaul boom end part 27 is provided with a cleat slot 46 (FIG. 5) which extends between the bore 42 and the central bore 37. The cleat slot 46 includes cleat ridges 47 which are identical to the cleat ridges 40, and the bottom surface 48 of the cleat slot 46 slants downwardly from the bore 42 to the bore 37.

A slot 49 (FIG. 4) is formed in the bottom surface 35 and extends between the bore 38 and the central bore 37. The bottom surface 50 of the slot curves downwardly from the bore 37 to the bore 38.

The top and bottom surfaces 34 and 35 of the inhaul boom end part 27 are mirror images, and the upper and lower cleat slots 36 and 46 are identical and the upper and lower slots 43 and 49 are identical. Each of these slots extends from one of the bores 38 or 42 to the central bore 37.

A large bore 51 extends through the forward portion of the inhaul boom end part for attaching a conventional sailboard uphaul line.

A resilient rubber bumper 52 is attached to the forward end of the inhaul boom end part 27. With the exception of the bumper 52, the inhaul boom end part may be molded integrally from plastic. The parting line of a two-part mold extends in a plane which is parallel to the top and bottom surfaces 34 and 35, and the cleat ridges 40 and 47 extend perpendicularly to the parting line and parallel to the direction in which the mold parts separate.

The inhaul boom end part 27 is lashed to the mast 22 with a lash line 59 (FIG. 6). The boom end part is lashed to the boom when the boom end part is oriented so that the booms extend almost parallel to the mast and either the top surface 34 or bottom surface 35 is adjacent the mast. If the bottom surface of the boom end part is adjacent the mast, only the bottom edge of the cylindrical wall 32 engages the mast and the outhaul ends of the booms extend adjacent the top of the mast. One end of the lash line 54 is cleated in the bottom cleat slot 46 and is threaded upwardly through the bore 42, through the slot 43, and downwardly through the central bore 37. The line is wrapped around the mast 22 once or twice and then fed through the bottom of bore 38 and into the upper cleat slot 36. The desired tension is exerted on the line by pulling the line in the direction of the cleat slot 36, and the line is anchored by pulling it downwardly into the cleat slot 36. The cleat ridges engage the line and maintain the desired tension. The free end of the lash line extends away from the cleat slot 36 and is shown wrapped loosely around one of the booms 24.

The booms and the boom end part are then rotated relative to the mast to bring the booms into their operating position shown in FIG. 1 in which the booms extend in a plane which is generally perpendicular to the mast and the cylindrical wall 32 engages the mast as shown in FIG. 6. As the boom end part rotates, the bottom of each bore 37, 38, and 42 rotates away from the mast. The line 54 is thereby further tensioned and resiliently secures the boom assembly to the mast. When the line is positioned in the cleat slot, the line extends at an angle to the cleat ridges. Tension on the line tends to draw the line downwardly through bore 38, and the line wedges between the peaks of the opposed cleat ridges.

The inhaul boom end part 27 can also be attached to the mast with the boom assembly oriented so that the top surface 34 of the end part is adjacent the mast and outhaul ends of the booms extend adjacent the bottom of the mast. The procedures previously described is followed for lashing the inhaul end part to the mast except that the first end of the line is cleated in cleat slot 36, the line is wrapped around the mast, and the second end of the line is then cleated in cleat slot 46.

In an alternative procedure for lashing the boom end part the first end of the line is knotted and fed downwardly through the bore 42 in the top surface of the boom end part, wrapped around the mast once or twice, and the other end of the line is fed upwardly through the bore 38 and cleated in the cleat slot 36. The knot in the first end of the line engages the edge of the bore 42 to anchor the first end.

The rotational movement of the boom assembly into its operating position is conventional. However, the invention facilitates the lashing operation and the adjustment of the tension on the line. Cleats are provided on both the top and bottom of the boom end part, and the cleats are positioned adjacent the mast. Both of the cleat slots are oriented toward the central bore 37 and are oriented in the direction in which the line is pulled in order to tension the line. Each cleat slot extends in a direction which is generally tangent to the mast (see FIG. 6) so that the line can be pulled and cleated without interference from the mast.

The cleats are recessed within the boom end part so that they are protected against breakage and do not interfere with the smooth surface of the boom end part. The structure of the boom end part and the orientation of the cleat ridges permit the part to be molded integrally from plastic, thereby reducing the cost of the part and providing a more durable part.

Although the particular embodiment illustrated has cleat slots in both the top and bottom surfaces of the boom end part, the first end of the line could be secured by means other than a jam cleat. For example, a knot in the line could engage the end of the bore 42. However, the use of two cleat slots increases the versatility of the boom end part and permits the tension on the line to be adjusted from either the top or the bottom of the boom end part.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. An inhaul boom end part for a sailboard boom assembly having a pair of booms, the inhaul boom end part being generally V-shaped and having top and bottom surfaces and a pair of diverging tubular portions for attaching the inhaul boom end part to the booms, an arcuate surface between the tubular portions for engaging a mast of a sailboard, means for securing one end of a line for attaching the inhaul boom end part to the mast, said top surface having a slot therein and a jam cleat positioned in said slot and formed integrally with the inhaul boom end part for securing the other end of the line.

2. The structure of claim 1 in which the slot communicates with a bore which extends through the boom end part.

3. The structure of claim 1 in which slot the in the top surface has opposed, generally parallel side surfaces, the jam cleat in the slot being provided by ridges which extend from each of the slot surfaces toward the other slot surface, each of the ridges having a base and a top, the distance between the ridges on the opposed surfaces increasing from the base of the ridges to the top of the ridges.

4. The structure of claim 1 in which the inhaul boom end part has a slot in the bottom surface, and a jam cleat in the slot in the bottom surface.

5. The structure of claim 4 in which the slot in the top surface communicates with a first bore which extends through the boom end part and the slot in the bottom surface communicates with a second bore which extends through the boom end part.

6. The structure of claim 4 in which the inhaul boom end part has a central bore which extends through the boom end part adjacent the arcuate surface and the slots in the top and bottom surface of the inhaul boom end part extend away from said central bore.

7. The structure of claim 4 in which each of the slots in the top and bottom surfaces has opposed, generally parallel side surfaces, the jam cleat in each slot being provided by ridges which extend from each of the slot surfaces toward the other slot surface, each of the ridges having a base and a top, the distance between the ridges on the opposed surfaces increasing from the base of the ridges to the top of the ridges.

8. The structure of claim 1 in which the boom inhaul end part is integrally molded.

9. An inhaul boom end part for a sailboard boom assembly having a pair of booms, the inhaul boom end part being generally V-shaped and having top and bottom surfaces and a part of diverging tubular portions for attaching the inhaul boom end part to the booms, an arcuate surface between the tubular portions for engaging a mast of a sailboard, means for securing one end of a line for attaching the inhaul boom end part to the mast, a central bore which extends generally perpendicularly through the boom end part adjacent the arcuate surface and second and third bores which extend generally perpendicularly through the boom end part, a first slot in the top surface which extends from the central bore to said second bore, a second slot in said top surface which extends from the central bore to said third bore, and a jam cleat positioned in said first slot and formed integrally with the inhaul boom end part for securing the other end of the line.

10. The structure of claim 9 in which the bottom surface has a first slot which extends between the central bore and said third bore, a jam cleat in the first slot in the bottom surface, and a second slot in the bottom surface which extends between the central bore and said second bore.

11. The structure of claim 10 in which each of the first slots in the top and bottom surfaces have opposed, generally parallel side surfaces, the jam cleat in each slot being provided by ridges which extend from each of the slot surfaces toward the other slot surface, each of the ridges having a base and a top, the distance between the ridges on the opposed surfaces increasing from the base of the ridges to the top of the ridges.

12. The structure of claim 11 in which the first slot in the top surface has a bottom surface which extends downwardly from the central bore to said second bore and the first slot in the bottom surface of the inhaul boom end part has a bottom surface which extends upwardly from said central bore to said third bore.

13. The structure of claim 9 in which the second slot in the top surface has a bottom surface which curves upwardly from the central bore to said third bore and the second slot in the bottom surface on the inhaul boom end part has a bottom surface which curves downwardly from the central bore to said second bore.

* * * * *

UNITED STATES PATENT AND TRADEMARK OFFICE

CERTIFICATE OF CORRECTION

PATENT NO. : 4,681,052

DATED : July 21, 1987

INVENTOR(S) : Heinz F. Nedoluha

It is certified that error appears in the above-identified patent and that said Letters Patent is hereby corrected as shown below:

Col. 4, line 56 insert --the-- before "slot" and delete the first occurrence of "the".

Signed and Sealed this

First Day of December, 1987

*Attest:*

DONALD J. QUIGG

*Attesting Officer*

*Commissioner of Patents and Trademarks*